US006915849B2

(12) United States Patent
Nuth

(10) Patent No.: US 6,915,849 B2
(45) Date of Patent: Jul. 12, 2005

(54) APPARATUS AND METHODS FOR CONVEYING INSTRUMENTATION WITHIN A BOREHOLE USING CONTINUOUS SUCKER ROD

(75) Inventor: David Nuth, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/127,021

(22) Filed: Apr. 19, 2002

(65) Prior Publication Data

US 2002/0170711 A1 Nov. 21, 2002

Related U.S. Application Data

(60) Provisional application No. 60/285,891, filed on Apr. 23, 2001.

(51) Int. Cl.[7] ..... E21B 47/00

(52) U.S. Cl. ..... 166/254.2; 166/77.1; 166/242.2; 166/255.1; 166/385

(58) Field of Search ..... 166/384, 385, 166/242.2, 77.1, 77.2, 77.3, 254.2, 255.1

(56) References Cited

U.S. PATENT DOCUMENTS

| | | | | | |
|---|---|---|---|---|---|
| 3,559,905 | A | * | 2/1971 | Palynchuk | 242/390.5 |
| 4,457,370 | A | | 7/1984 | Wittrisch | 166/250 |
| 4,460,038 | A | | 7/1984 | Clamens | 166/66 |
| 4,682,657 | A | * | 7/1987 | Crawford | 166/385 |
| 4,794,791 | A | | 1/1989 | Wittrisch | 73/151 |
| 5,042,297 | A | | 8/1991 | Lessi | 73/155 |
| 5,080,175 | A | * | 1/1992 | Williams | 166/385 |
| 5,172,765 | A | * | 12/1992 | Sas-Jaworsky et al. | 166/384 |
| 5,184,682 | A | | 2/1993 | Delacour et al. | 166/385 |
| 5,217,075 | A | | 6/1993 | Wittrisch | 166/302 |
| 5,234,058 | A | * | 8/1993 | Sas-Jaworsky et al. | 166/385 |
| 5,348,097 | A | * | 9/1994 | Giannesini et al. | 166/385 |
| 5,505,259 | A | | 4/1996 | Wittrisch et al. | 166/250.01 |
| 5,608,214 | A | * | 3/1997 | Baron et al. | 250/262 |
| 5,636,686 | A | | 6/1997 | Wittrisch | 166/66 |
| 5,749,417 | A | * | 5/1998 | Delatorre | 166/254.2 |
| 6,157,761 | A | * | 12/2000 | Wittrisch | 385/107 |
| 6,173,787 | B1 | * | 1/2001 | Wittrisch | 166/384 |
| 6,179,058 | B1 | | 1/2001 | Wittrisch | 166/384 |
| 6,575,241 | B2 | * | 6/2003 | Widney et al. | 166/242.2 |
| 2003/0090390 | A1 | * | 5/2003 | Snider et al. | 340/853.3 |

FOREIGN PATENT DOCUMENTS

| | | | |
|---|---|---|---|
| FR | 2 652 160 | 3/1991 | G01N/1/10 |

OTHER PUBLICATIONS

Wiltse, D.J., "Fishing Jobs Using Continuous Rod," Weatherford Artificial Lift System, Mar. 30, 1999, 1 Page.

C–TECH Energy, Inc., Premier Petroleum Wellbore Steel Design, Fabrication Products and . . . "Pro–Rod: Coiled Rod Product Line" http://www.ctechenergy.com/ and http://www.ctechenergy.com/prorod_p.html Copyright 2001, 4 Pages.

PCT Partial International Search Report from International Application No. PCT/GB02/01827, Dated Jul. 17, 2002.

PCT Written Opinion, International Application No. PCT/GB02/01827, dated Jun. 18, 2003.

* cited by examiner

*Primary Examiner*—Hoang Dang
(74) *Attorney, Agent, or Firm*—Moser, Patterson & Sheridan, L.L.P.

(57) ABSTRACT

The present invention provides an apparatus and method for conveying downhole tools within a borehole using a continuous rod. The apparatus may include a continuous rod, a downhole tool attached to one end of the continuous rod, and a delivery rig for lowering the continuous rod and downhole tool into the wellbore.

12 Claims, 1 Drawing Sheet

APPARATUS AND METHODS FOR CONVEYING INSTRUMENTATION WITHIN A BOREHOLE USING CONTINUOUS SUCKER ROD

CROSS-REFERENCE TO RELATED APPLICATIONS

This application claims benefit of U.S. provisional patent application Ser. No. 60/285,891, filed Apr. 23, 2001, which is herein incorporated by reference.

BACKGROUND OF THE INVENTION

1. Field of the Invention

This invention is directed toward the operation of instrumentation within a well borehole, and more particularly directed toward formation logging, perforating, casing inspection, and other operations in borehole that deviate significantly from vertical, wherein required borehole instrumentation is conveyed by a continuous sucker rod and injector system.

2. Description of the Related Art

Modern oil and gas wells are typically drilled with a rotary drill bit and a circulating drilling fluid or "mud" system. The mud system (a) serves as a means for removing drill bit cuttings from the well as the borehole is advanced, (b) lubricates and cools the rotating drill bit, and (c) provides pressure within the borehole to balance internal pressures of formations penetrated by the borehole. Rotary motion is imparted to the drill bit by rotation of a drill string to which the bit is attached. Alternately, the bit is rotated by a mud motor which is attached to the drill string just above the drill bit. The mud motor is powered by the circulating mud system. Subsequent to the drilling of a well, or alternately at intermediate periods during the drilling process, the borehole is cased typically with steel casing, and the annulus between the borehole and the outer surface of the casing is filled with cement. The casing preserves the integrity of the borehole by preventing collapse or cave-in. The cement annulus hydraulically isolates formation zones penetrated by the borehole that are at different internal formation pressures.

Numerous operations occur in the well borehole after casing is "set". All operations require the insertion of some type of instrumentation or hardware within the borehole. Examples of typical borehole operations include:

(a) wireline logging to determine various formation parameters including hydrocarbon saturation;
(b) perforating of the casing in prospective zones so that hydrocarbons can be produced;
(c) setting packers and plugs to isolate producing zones;
(d) inserting tubing within the casing and extending the tubing to the prospective producing zone;
(e) logging with instruments conveyed with coiled tubing; and
(f) installing artificial lift equipment for producing zones with insufficient pressure to flow to the surface of the earth.

Some borehole operations are typically performed during the drilling of the well, such as logging while the well is being drilled using instrumentation conveyed by the drill string, intermediate wireline logging, directional surveying of the well, and directional steering of the drill bit during the drilling operation. Other borehole operations are performed during the life of the well and at the end of the life of the well, such as logging, casing inspection, perforation plugging, and resetting of packers and plugs.

Early oil and gas wells were typically drilled in a vertical or near vertical direction with respect to the surface of the earth. As drilling technology improved and as economic and environmental demands required, an increasing number of wells were drilled at angles which deviated significantly from vertical. As an example, fifty or more wells are commonly drilled in a variety of directions from a single offshore platform. In the 1990's, drilling horizontally within producing zones became popular as a means of increasing production by increasing the effective borehole wall surface exposed to the producing formation. It was not uncommon to drill sections of boreholes horizontally (i.e. parallel to the surface of the earth) or even "up-hill" where sections of the borehole were actually drilled toward the surface of the earth.

The advent of severely deviated boreholes introduced numerous problems in the performance of borehole operations. Conventional wireline logging was especially impacted. Wireline logging utilizes the force or gravity to convey logging instrumentation into a borehole. Gravity is not a suitable conveyance force in highly deviated, horizontal or up-hill sections of boreholes. Numerous methods have been used, with only limited success, to convey conventional wireline instrumentation or "tools" in highly deviated conditions. These methods include conveyance using a drill string, a coiled tubing, and a hydraulic tractor. All methods require extensive well site equipment, and often present severe operational, economic, and logistic problems. In general, conveyance of conventional wireline tools by means other than gravity are, at best, marginally successful.

An entire field of formation evaluation has been developed around the basic concept of measuring formation parameters while the borehole is being drilled. This methodology requires specially designed measurement-while-drilling (MWD) or logging-while-drilling (LWD) instrumentation. The instrumentation is conveyed by the drill string, and is mounted in the drill string near the drill bit. MWD and LWD systems are effective in highly deviated boreholes, and modern systems rival their wireline counterparts in accuracy and precision. The techniques do, however, require the use of a drilling or service rig that is generally expensive and often operationally impractical in older and more remote wells. In addition, any tubing in the well must be pulled, thereby adding to the monetary and operational expense. It should also be noted that drill strings have been used as a means of conveyance and operation of other types of equipment such as packers and plugs, but also at great operational and monetary expense.

Conventional wireline and other well service systems have been configured for coiled tubing conveyance. This method of conveyance is operable in highly deviated well boreholes. Although not as costly as drill string conveyed equipment requiring a drilling or service rig, coiled tubing and associated injector equipment is still physically large and presents many drawbacks that are encountered with drill string conveyed systems.

Downhole tractors are designed to literally pull downhole instrumentation and hardware in highly deviated boreholes.

Tractors utilize rotating radial members which grip the walls of the borehole and therefore convey the tractor axially along the borehole. Tractors are relatively complicated, hydraulically operated pieces of equipment and lack reliability, especially in deep wells and wells with highly corrosive borehole fluids.

In view of the above discussion, it is apparent that a reliable, relatively inexpensive, versatile and operationally efficient system is needed to convey and operate borehole equipment in boreholes which are highly deviated from the vertical.

SUMMARY OF THE INVENTION

Fluids can be produced from oil and gas wells by utilizing internal pressure within a producing zone to lift the fluid through the well borehole to the surface of the earth. If internal formation pressure is insufficient, artificial fluid lift means and methods must be used to transfer fluids from the producing zone and through the borehole to the surface of the earth.

The most common artificial lift technology utilized in the domestic oil industry is the sucker rod pumping system. A sucker rod pumping system consists of a pumping unit that converts a rotary motion of a drive motor to a reciprocating motion of an artificial lift pump. A pump unit is connected to a polish rod and a sucker rod "string" which, in turn, operationally connects to a rod pump in the borehole. The string can consist of a group of connected steel sucker rods sections (commonly referred to as "joints") in lengths of 25 or 30 feet (ft), and in diameters ranging from ⅝ inches (in.) to 1-¼ in. Alternately, a continuous sucker rod (hereafter referred to as COROD) string can be used to operationally connect the pump unit at the surface of the earth to the rod pump positioned within the borehole.

The present invention uses a COROD string and a delivery mechanism rig used to force the string into the borehole (hereafter CORIG) as a means and method for conveying and operating a wide variety of equipment within a borehole. The invention works equally well in vertical and highly deviated wells.

When the COROD/CORIG system is used in logging operations, the downhole tools record data of interest in memory within the downhole tool rather than telemetering the data to the surface as in conventional wireline logging. Data are subsequently retrieved from memory when the tool is withdrawn from the borehole. The tool position is synchronized with a depth encoder, which is preferably at the surface near the CORIG injector apparatus. The depth encoder measures the amount of COROD string within the well at any given time. Data measured and recorded by the downhole tool is then correlated with the depth encoder reading thereby defining the position of the tool in the well. This information is then used to form a "log" of measured data as a function of depth within the well at which the data are recorded.

Other apparatus and services are operable with the COROD/CORIG system. These services and associated equipment include perforating, casing inspection, the setting of packers and plugs, and borehole fishing services.

The COROD/CORIG system for operating and conveying downhole equipment in highly deviated wells is more reliable and requires less equipment, less time, and less cost than previously discussed conveyance systems. These systems include drill string conveyed systems, coiled tubing conveyed systems, and downhole tractor conveyed systems. The COROD can be used for multiple runs into a well with no fatigue as compared to coiled tubing operations. COROD can be run through tubing thereby eliminating the additional cost and time required to pull conventional to run drill string, coiled tubing, or tractor conveyed systems.

It is also noted that the COROD/CORIG system for conveying equipment is not limited to oil and gas well applications. The system is equally applicable to pipeline where pipeline inspection services are run.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

DETAILED DESCRIPTION OF THE PREFERRED EMBODIMENT

Figure 1:
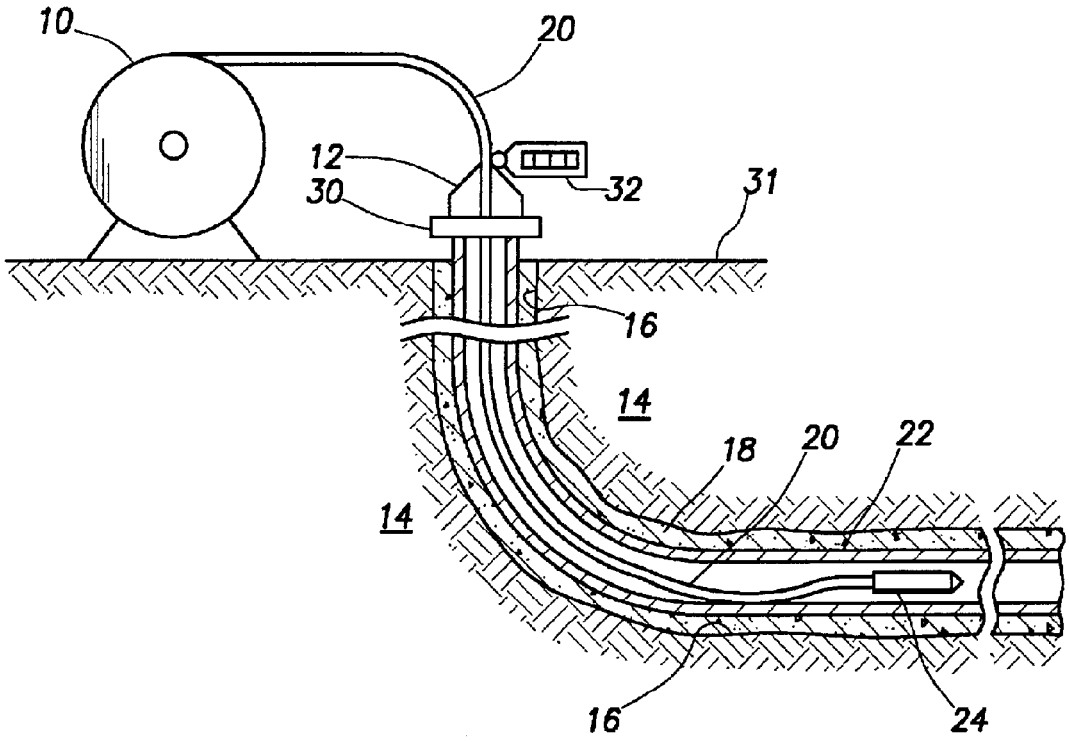
FIG. 1 is a highly conceptualized illustration of a COROD/CORIG system operating in a highly deviated well borehole.

FIG. 1 illustrates conceptually the operation of a COROD/CORIG system in a highly deviated oil or gas well penetrating earth formation 14. A COROD string 20 is positioned at a well site using a rotatable storage reel 10. The well site comprises a well borehole 16 containing casing 22. Cement 18 fills the casing-cement annulus. For purposes of illustration, upper portion of the well is essentially vertical, and the lower portion of the well is essentially horizontal. A well head 30 is affixed to the casing 22 above the surface of the earth 31. A CORIG delivery mechanism 12 is affixed preferably to the wellhead 30. The CORIG mechanism provides the force required to insert and withdraw the COROD string 20, and thereby convey a borehole instrument 24 affixed to a downhole end of the COROD string 20. A depth encoder 32 records the amount of COROD string within the borehole 16 at any given time thereby determining the position of the instrument 24 within the well.

Figure 2:
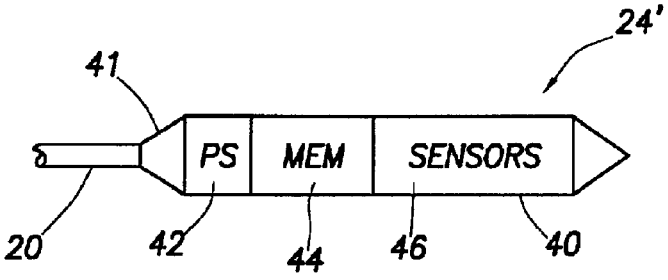
FIG. 2 illustrates a piece of borehole equipment which is conveyed and operated by the COROD/CORIG system within the borehole.

FIG. 2 is a more detailed illustration of a borehole instrument and is identified by the numeral 24'. For purposes of discussion assume that the instrument 24' is a logging instrument which comprises a pressure tight housing 40 attached to the downhole end of the COROD 20 by a suitable instrument head 41. The instrument 24' contains a sensor package 46 which responds to formation and borehole parameters of interest. The sensors can be of the nuclear, acoustic, or electromagnetic type, or combinations of these types. Response data from the sensor package 46 are recorded in a memory 44 for subsequent retrieval and processing when the instrument 40 is withdrawn from the borehole 16. A power supply 42, which is typically a battery pack, provides operational power for the sensor package 46 and memory 44. When data are retrieved from the memory, they are correlated with the depth encoder 32 response to form a "log" of measured parameters of interest as a function of depth within the borehole.

The instrument package 24 as shown in FIG. 1 can be any type of borehole instrumentation, such as a casing perforating "gun" for perforating the casing 22 in a formation zone 14 of interest. The instrument can also be a casing inspection tool, or a production logging tool to measure the amount and type of fluid flowing within the casing 22 or within production tubing (not shown). The instrument 24 can also be a fishing tool that is used to retrieve unwanted hardware from the borehole. Examples of a fishing tool include overshot or spear.

Again referring to FIG. 1, it should be noted that the instrument 24 need not be retrieved when the COROD 20 is withdrawn from the borehole by the CORIG injector 12. As an example, the instrument 24 can be a packer or a plug, which is left positioned within the borehole when the COROD is withdrawn. Thus, the COROD is suitable for delivering or operating completions tools.

As mentioned previously, the COROD/CORIG system for conveying equipment is not limited to oil and gas well applications, but is equally applicable to pipeline applications where pipeline inspection services are run. Specific examples of the COROD/CORIG embodied as a pipeline service tool are not illustrated in that such an illustration would be very similar to the illustration in FIG. 1.

In addition to the embodiments described above, wherein continuous rod is used with memory-type logging devices, the invention is equally usable with more traditional wireline logging methods dependent upon a conductor to transmit data as logging operations are taking place. Continuous sucker rod like that described herein can be manufactured with a longitudinal bore therethrough to house a conductor suitable for transmitting data. In one example, conductor is place within an internal bore of the rod prior to rolling the rod on a reel. As the logging tools are assembled at one end of the rod, a mechanical and electrical connection is made between the conductor housed in the rod and the tools connected to the end of the rod prior to insertion into the wellbore. In this manner, the rod is used to both carry the tools downhole and to transmit data from the tools to the surface of the well.

In another embodiment, the continuous rod itself can act as a conductor to transmit data to the surface of a well. For example, rod can be covered with a coating of material having the appropriate conductive characteristics to adequately transmit signals from downhole logging tools. In this manner, no additional conductor is necessary to utilize the downhole logging tools run at the end of continuous rod.

Additionally, continuous sucker rod can be used to transport logging tools that are capable of real time communication with the surface of the well without the use of a conductor. For example, using a telemetry tool and gamma ray tool disposed on the continuous sucker rod string having various other remotely actuatable tools disposed thereupon, the location of the apparatus with respect to wellbore zones of interest can be constantly monitored as the telemetry tool transmits real time information to a surface unit. At the surface, the signals are received by signal processing circuits, which may be of any suitable known construction for encoding and decoding, multiplexing and demultiplexing, amplifying and otherwise processing the signals for transmission to and reception by the surface equipment. The operation of the gamma ray tool is controlled by signals sent downhole from the surface equipment. These signals are received by a tool programmer which transmits control signals to the detector and a pulse height analyzer.

The surface equipment includes various electronic circuits used to process the data received from the downhole equipment, analyze the energy spectrum of the detected gamma radiation, extract therefrom information about the formation and any hydrocarbons that it may contain, and produce a tangible record or log of some or all of this data and information, for example on film, paper or tape. These circuits may comprise special purpose hardware or alternatively a general purpose computer appropriately programmed to perform the same tasks as such hardware. The data/information may also be displayed on a monitor and/or saved in a storage medium, such as disk or a cassette.

The electromagnetic telemetry tool generally includes a pressure and temperature sensor, a power amplifier, a downlink receiver, a central processing unit and a battery unit. The electromagnetic telemetry tool is selectively controlled by signals from the surface unit to operate in a pressure and temperature sensing mode, providing for a record of pressure versus time or a gamma ray mode which records gamma counts as the apparatus is raised or lowered past a correlative formation marker. The record of gamma counts is then transmitted to surface and merged with the surface system depth/time management software to produce a gamma ray mini log which is later compared to the wireline open-hole gamma ray log to evaluate the exact apparatus position. In this manner, components, including packers and bridge plugs can be remotely located and actuated in a wellbore using real time information that is relied upon solely or that is compared to a previously performed well log.

While the foregoing disclosure is directed toward the preferred embodiments of the invention, the scope of the invention is defined by the claims, which follow.

What is claimed is:

1. An apparatus for conveying a downhole tool, comprising:

a continuous rod string having a conductor to transmit data, wherein the conductor comprise a coating material;

a delivery rig for delivering the rod string;

a downhole tool attached to one end of the rod string, the downhole tool having a memory member for collecting data;

a depth encoder for measuring the amount of rod string extended into a borehole; and a surface unit including circuitry for receiving data signals from the downhole tool, extracting data from the data signals and correlating the extracted data with data from the depth encoder to form a log, wherein the conductor transmits the data signals from the downhole tool to the surface unit.

2. The apparatus of claim 1, wherein the downhole tool is selected from the group consisting of a logging instrument, a perforating gun, a casing inspection tool, a production logging tool, a packer, a plug, and combinations thereof.

3. The apparatus of claim 1, wherein the downhole tool comprises a logging instrument attached to the rod string using an instrument head.

4. The apparatus of claim 3, wherein the logging instrument comprises:

a housing;

a sensor disposed in the housing; and a power supply.

5. The apparatus of claim 4, wherein the sensor is selected from the group consisting of nuclear sensor, acoustic sensor, electromagnetic sensor, and combinations thereof.

6. The apparatus of claim 1, further comprising a rotatable storage reel.

7. A method of operating a tool in a wellbore, comprising:

operatively connecting at least one tool to a string of continuous rod;

running the at least one tool into the wellbore;

transmitting data signals through a coating of conductive material on the string of continuous rod;

operating the at least one tool;

collecting data signals from a memory member in the at least one tool;

measuring the depth of the at least one tool;

correlating the data signals with the depth measurements to form a log.

8. The method of claim 7, wherein the at least one tool is selected from the group consisting of a logging instrument, a fishing tool, a completions tool, or combinations thereof.

9. The method of claim 8, wherein the logging instrument includes a memory means.

10. The method of claim 8, wherein the logging instrument includes a power supply.

11. The method of claim 8, wherein the fishing tool includes an overshot or spear.

12. The method of claim 8, wherein the completions tool includes a packer or a plug.

* * * * *